US005938123A

United States Patent [19]

Heitzman

[11] Patent Number: 5,938,123

[45] Date of Patent: Aug. 17, 1999

[54] SHOWER HEAD WITH CONTINUOUS OR CYCLING FLOW RATE, FAST OR SLOW PULSATION AND VARIABLE SPRAY PATTERN

[76] Inventor: Charles J. Heitzman, 1330 Ala Moana Blvd., Apt. 908, Honolulu, Hi. 96814

[21] Appl. No.: 08/946,934

[22] Filed: Oct. 8, 1997

[51] Int. Cl.[6] ..... B05B 1/34

[52] U.S. Cl. ..... 239/383; 239/380; 239/546

[58] Field of Search ..... 239/380, 381, 239/322, 383, 546

[56] References Cited

U.S. PATENT DOCUMENTS

| | | | |
|---|---|---|---|
| Re. 26,889 | 5/1970 | Hindman | 239/546 |
| 3,967,783 | 7/1976 | Halsted et al. | 239/381 |
| 4,588,130 | 5/1986 | Trenary et al. | 239/381 |

*Primary Examiner*—Andres Kashnikow
*Assistant Examiner*—Sean P. O'Halon
*Attorney, Agent, or Firm*—Jacox, Meckstroth & Jenkins

[57] ABSTRACT

A shower head assembly includes a housing enclosing a rotary valve member driven by a water activated motor. A rotatable tubular valve member surrounds the housing and has. an internal cartridge with circumferentially spaced internal passages for selectively directing continuous flow water or cycling flow water directly to nozzle orifices or to radially inner or outer sets of drive jets for a water pulsating turbine wheel. The spray discharge orifices may be adjusted by a control ring which cooperates with the valve member to provide for selecting various spray functions including 1) a normal continuous spray, 2) a fast or slow pulsating spray, 3) a cycling flow rate spray with fast or slow pulsation, 4) a cycling flow rate spray with no pulsation and 5) a discharge spray variable between narrow and wide spray patterns.

13 Claims, 2 Drawing Sheets

SHOWER HEAD WITH CONTINUOUS OR CYCLING FLOW RATE, FAST OR SLOW PULSATION AND VARIABLE SPRAY PATTERN

BACKGROUND OF THE INVENTION

This invention relates to a pulsating fluid spray device or shower head of the general type disclosed in U.S. Pat. Nos. 3,473,736, 3,568,716, 4,101,075 and 5,577,664, all of which issued to Applicant. In such a device or shower head, it has been found desirable to provide for a simplified and durable construction as well as provide for conveniently selecting different spray functions. For example, it has been found desirable for the shower head to provide for selecting a variable spray pattern between a wide spray pattern and a narrow or concentrated spray pattern, high or low frequency pulsation of the discharge spray, and/or cycling of the water flow rate above and below a standard maximum code requirement of 2.5 gallons per minute (GPM). It is also desirable for the shower head to provide different combinations of continuous or cycling flow rates and variable frequency pulsation and variable spray patterns. The shower heads disclosed in the above patents provide some of these desirable functions, but do not provide all of the selectable features or spray functions.

SUMMARY OF THE INVENTION

The present invention is directed to an improved shower head assembly which provides all of the desirable features mentioned above and which is compact and dependable in construction and simple to use for selecting the various spray functions. In accordance with one embodiment of the invention, a shower head is constructed of substantially all plastic components and includes a generally cylindrical housing enclosing a water activated motor having a rotor which slowly rotates a cylindrical valve member having peripherally spaced axially extending grooves. The housing has radial ports above and around the valve member, and a rotatable annular valve member or sleeve surrounds the housing. The sleeve has an internal cartridge with circumferential spaced and axially extending passages of different lengths for selectively connecting the ports to different passages within the base of the housing.

A base member and cap member are connected to the bottom of the housing and define a chamber which encloses a multiple speed water activated turbine wheel for pulsating water streams directed into nozzles which may be adjusted by a rotatable control ring for varying the spray pattern from the nozzles. By rotation of the annular valve sleeve, the user may select a continuous flow spray, a fast or slow pulsating spray, a cycling flow rate spray, a variable frequency pulsating spray, or different combinations. By rotation of the spray control ring, the user may select a discharge spray between narrow and wide spray patterns.

Other features and advantages of the invention will be apparent from the following description, the accompanying drawings and the appended claims.

DESCRIPTION OF THE PREFERRED EMBODIMENTS

Figure 1:
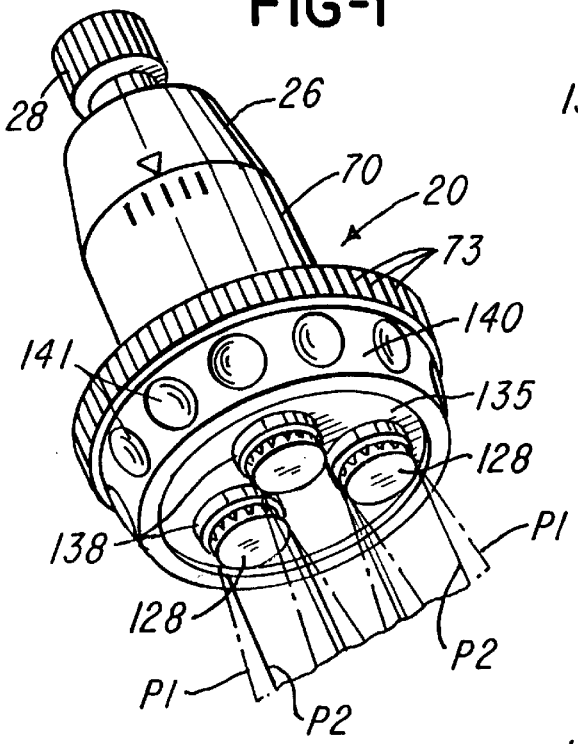
FIG. 1 is a perspective view of a shower head constructed in accordance with the invention.
Figure 2:
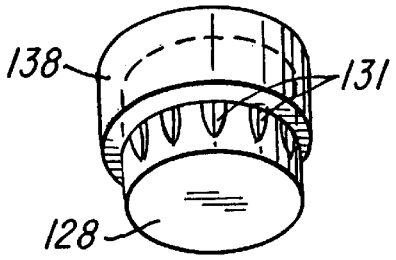
FIG. 2 is an enlarged perspective view of an adjustable spray nozzle shown in FIG. 1.
Figure 4:
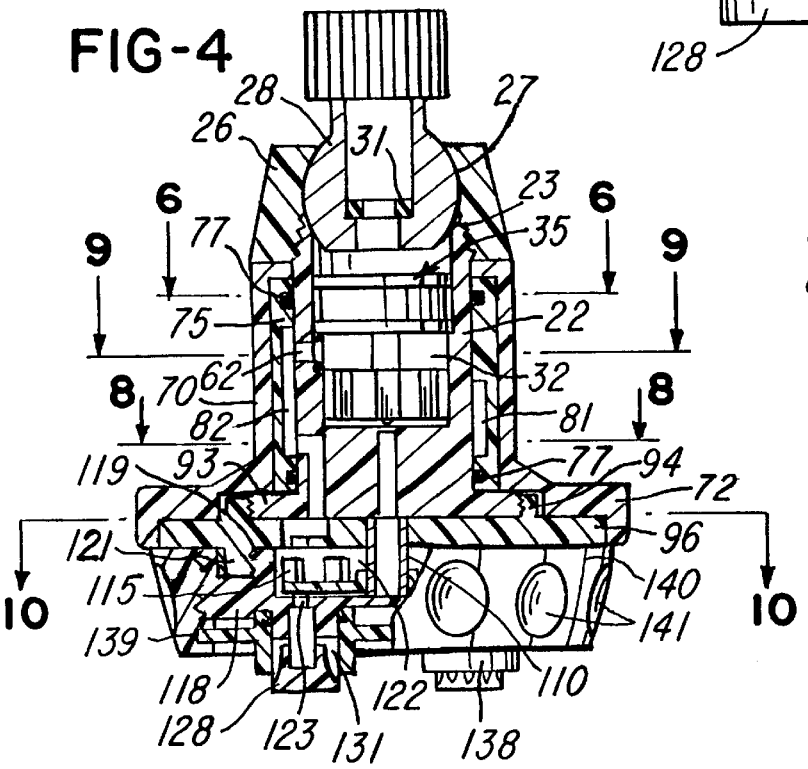
FIG. 4 is an axial section of the shower head shown in FIG. 1.

An assembled shower head 20 is shown in FIG. 1 and an axial section in FIG. 4, and includes a housing 22 (FIG. 4) having an upper end portion defining an annular seat 23 and external threads for receiving an injection molded annular cap 26 having a part-spherical internal surface 27. The seat 23 and surface 27 receive a part-spherical outer surface of a tubular fitting 28 which may be metal or plastic. The upper end portion of the fitting 28 has an external ribbed surface and internal threads (not shown) for securing the fitting 28 to a water supply line. A flexible rubber flow washer 31 seats on an annular shoulder within the fitting 28 and distorts as the water pressure increases to provide a substantially constant predetermined flow rate of water into the shower head 20 regardless of fluctuations in water pressure.

Figure 6:
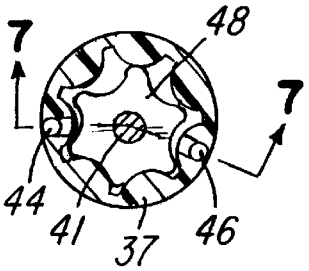
FIG. 6 is a section taken generally on the line 6—6 of FIG. 4.

The housing 22 has a stepped internal cylindrical chamber 32 which receives a water actuated gear type motor 35 (FIGS. 4, 6 & 7) including a two section circular housing 37 (FIG. 7) supporting a rotary shaft 39 having eccentric shaft portion 41 and a downwardly projecting square output drive portion 43. The housing sections have a water inlet passage 44 extending from the top of the motor 35 and an outlet passage 46 extending to the bottom of the motor. A gear-like rotor 48 is supported by the eccentric shaft portion 41 for free rotation and has peripherally spaced concave surfaces which progressively mate with inwardly projecting convex surfaces on the housing 37 when the rotor 48 orbits around inside the housing 37. As pressurized water flows from the inlet passage 44 to the outlet passage 46, the water pressure causes the rotor 48 to orbit within the cavity of the housing 37 to produce very slow rotation of the square drive shaft portion 43.

Figure 5:
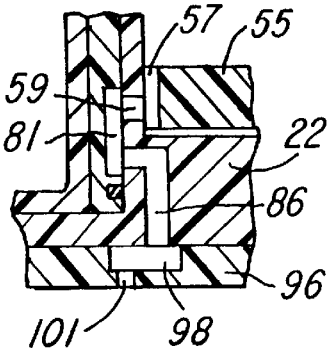
FIG. 5 is an enlarged fragmentary section of a portion of the shower head shown in FIG. 4 and showing a setting for a cycling flow rate in combination with low speed pulsation.
Figure 9:
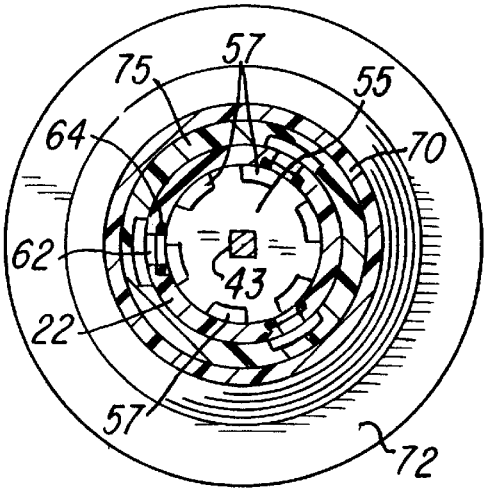
FIG. 9 is a section taken generally on the line 9—9 of FIG. 4.
Figure 11:
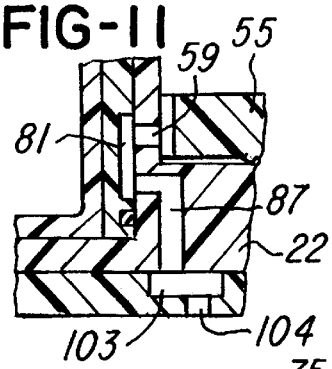
FIG. 11 is a fragmentary section similar to FIG. 5 and illustrating the setting for cycling flow rate in combination with high speed pulsation.
Figure 13:
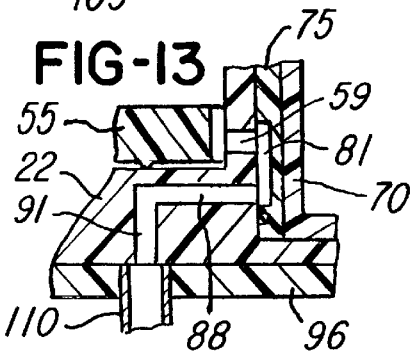
FIG. 13 is a fragmentary section similar to FIG. 12 and illustrating the setting for a cycling flow rate with a continuous spray.

The stepped chamber 32 within the housing 22 also receives a rotary valve member 55 (FIGS. 7 & 9) which is spaced below the motor 35 and is rotated by the square output shaft portion 43 of the motor 35. The valve member 55 has peripherally spaced and axially extending grooves or slots 57, and a set of peripherally spaced radial ports 59 (FIGS. 5, 11 & 13) are formed within the housing 22 around the rotary valve member 55. The housing also has a set of three peripherally spaced ports 62 (FIGS. 4 & 9) positioned above the valve member 55 and below the motor 35 for receiving the water flowing into the chamber 32 below the motor 35 through the outlet port 46. Each of the ports 62 may incorporate a flexible flow washer 64 in order to limit the combined flow through the ports 62 to a predetermined maximum flow rate, for example, 2.5 gallons per minute (gpm).

Figure 8:
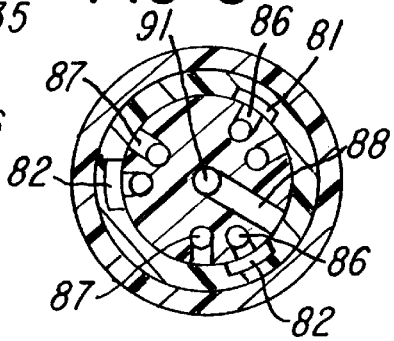
FIG. 8 is a section taken generally on the line 8—8 of FIG. 4.

A tubular or annular valve control member or sleeve 70 surrounds the housing 22 and includes an outwardly projecting base flange portion forming an upper control ring 72 having peripherally spaced gripping ribs 73 (FIG. 1). The control sleeve 70 has an internal cylindrical counterbore which confines a cylindrical interchangeable cartridge 75 which carries a pair of upper and lower resilient O-rings 77 to form fluid-tight seals with the outer surface of the housing. The cartridge 75 has a series of peripherally spaced and axial extending grooves or passages 81 and 82 (FIGS. 4 & 8) which have different lengths for selectively connecting with the ports 59 or the ports 62 in response to manual rotation of the cartridge 75 with the control sleeve 70.

Figure 12:
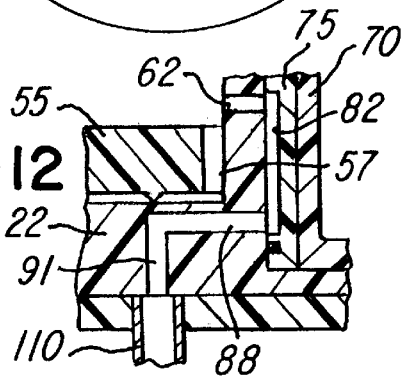
FIG. 12 is a fragmentary section similar to FIG. 11 and illustrating the setting for normal continuous spray.

A series of peripherally spaced angular passages 86 and 87 (FIGS. 5 & 11) and a radial passage 88 (FIGS. 12 & 13) are formed within the lower portion of the housing 22, and the upper or outer ends of the passages 86, 87 and 88 are selectively connected to the passages 81 and 82 in response to rotation of the control valve sleeve 70. The radial passage 88 connects with an axially extending center passage 91 (FIGS. 12 & 13) which extends to the bottom surface of the housing 22.

Figure 10:
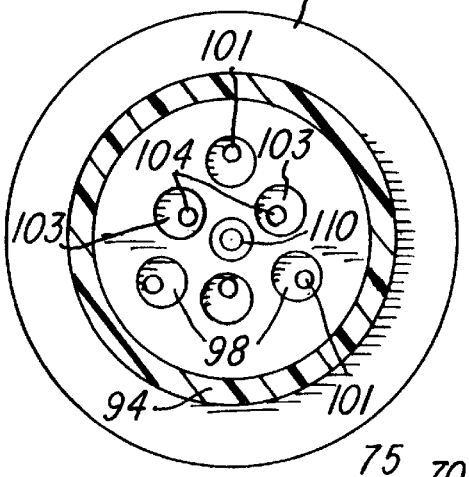
FIG. 10 is a section taken generally on the line 10—10 of FIG. 4.

The housing 22 has an outwardly projecting bottom flange 93 with external threads which receives an internally threaded annular portion 94 of a bottom nozzle member or plate 96 having a cylindrical outer surface surrounded by a skirt portion of the upper control ring 72. The top surface of the nozzle plate 96 has a set of three angularly spaced cylindrical outer cavities 98 (FIGS. 5 & 10) each having an angularly directed jet opening 101. The plate 96 also has another set of three angularly spaced inner cavities 103 (FIGS. 10 & 11) each of which has an angularly directed inner jet opening 104. The cavities 98 and 103 connect with corresponding passages 86 and 87, respectively, within the housing 22, and a tubular shaft 110 is supported by the center of the plate 96 and aligns with the center passage 91 within the housing 22.

Figure 3:
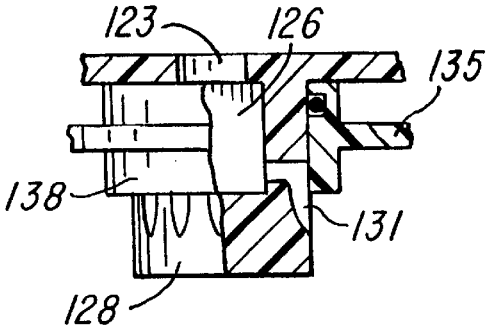
FIG. 3 is a fragmentary section of the spray nozzle shown in FIG. 2.
Figure 7:
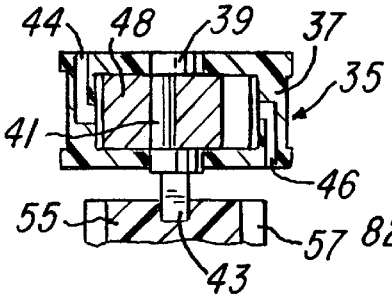
FIG. 7 is a section taken generally on the line 7—7 of FIG. 6.

A pulsating turbine wheel 115 (FIG. 4) is constructed as shown in FIG. 7 of above mentioned U.S. Pat. No. 5,577,664, the disclosure of which is incorporated by reference. The turbine wheel 115 is supported for free rotation by the tubular shaft 110 and is also free to move axially on the shaft between a bottom pulsating position (FIG. 4) and an elevated position (not shown) when pulsation is not desired. A circular cap member 118 (FIG. 4) has an upwardly projecting annular portion 119 which is threadably connected to a downwardly projecting annular portion 121 on the member or plate 96. The cap member 118 defines an inner cylindrical chamber 122 which receives the turbine wheel 115 and has three angularly spaced ports 123 directly under the base wall of the turbine wheel 115. The ports 123 (FIG. 3) extend to corresponding chambers 126 defined within three cylindrical nozzle bosses 128 projecting downwardly from the cap member 118.

A series of peripherally spaced nozzle channels or orifices 131 (FIG. 3) are formed within each boss 128 and connect with the corresponding center chamber 126. A spray control plate 135 has three angularly spaced cylindrical collars 138 (FIG. 3) which surround the corresponding bosses 128. The outer circular edge portion of the plate 135 is slidably received within an internal groove 139 formed within a control ring 140 having internal threads which engage external threads on the cap member 118 to provide for axial adjustment of the ring 140 and control plate 135.

When the internally threaded control ring 140 is rotated or unthreaded on the cap member 118 by gripping within indentations 141, the plate 135 and corresponding collars 138 shift axially on the bosses 128 from an upper position (FIGS. 3 & 4) where the channels 131 and collars 138 cooperate to produce a wide spray pattern P1 (FIG. 1). When the ring 140 and control plate 135 move downwardly in response to rotation of the control ring, the collars 138 cooperate with the channels 131 to produce a narrow or concentrating spray pattern P2.

In operation of the shower head 20, various spray functions may be selected by rotation of the control valve member or sleeve 70 though its control ring 72 and/or rotation of the lower control ring 140. For example, with the position of the control valve member or sleeve 70 as shown in FIG. 4, water flowing through the motor 35 flows outwardly through the ports 62. The water then flows downwardly through the passages 82 and 86 to the outer set of cavities 98 and drive jet orifices 101 to rotate the turbine wheel 115 at its lower speed. This produces constant low speed pulsation of the spray jets exiting from the channels 131. When the control ring 72 is indexed or rotated to a position where the ports 59 are connected to the passages 86 by the passages 81 (FIG. 5), the flow rate of water causing the lower speed pulsation of the spray jets is also cycled by the rotating valve member 55 between higher and lower flow rates, such as between 3.5 gpm and 1.5 gpm, with the result of an average of 2.5 gpm, a commonly acceptable code flow rate.

When the upper control ring 72 is rotated to a position (FIG. 11) where the passages 81 connect the cycling ports 59 to the inner set of cavities 103 through the corresponding passages 87, the cycling flow rate of water is directed through the inner set of jet orifices 104 to rotate the turbine wheel 115 at a higher speed, thereby producing a higher frequency of pulsation in combination with a variable flow rate. When the control ring 72 is rotated to a position (FIG. 12) where the passages 82 connect the passages 62 to the passages 88 and 91, the entire flow of water is directed downwardly through the tube 110. This elevates the turbine wheel 115, as described in above mentioned U.S. Pat. No. 5,577,664, and the continuous flow of water into the chamber 122 under the turbine wheel, is directed through the ports 123 to produce a normal, non-pulsating, and non-cycling continuous spray from the spray channels 131.

When the control ring 72 is rotated to a position (FIG. 13) where the passages 81 connect the ports 59 to the ports 88 and 91, the cycling flow rate of water produced by the rotating valve member 55, is directed downwardly through the tube 110 to produce a non-pulsating discharge spray with a cycling flow rate. In order to produce fast pulsation without cycling, the passages 87 extending from the inner set of cavities 103 are connected by the channels or passages 82 to the ports 62 above the valve member 55. As mentioned above, the spray pattern from the nozzle channels 131 may be varied between a wide spray pattern P1 and a narrow spray pattern P2 by rotation of the control ring 140 which shifts the collars 138 axially on the corresponding bosses 128 to vary the direction of the spray jets from the nozzle channels 131.

Figure 14:
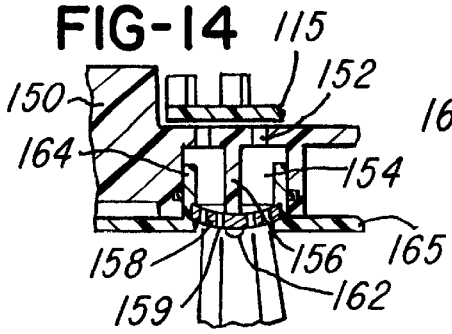
FIG. 14 is a fragmentary section similar to FIG. 3 and showing a modification of a variable spray nozzle assembly.
Figure 15:
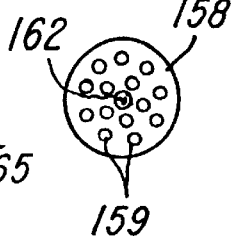
FIG. 15 is an axial bottom end view of the flexible spray plate shown in FIG. 14.

Referring to FIGS. 14 and 15 which show a modification of the shower head 20 in accordance with the invention, a cap member 150 has a chamber for receiving the pulsating turbine 115 directly above a set of ports 152 for each of three angularly spaced nozzle chambers 154. A post 156 projects downwardly within the center of each chamber 154 and supports the center portion of a flexible plastic nozzle disk 158 having an array of nozzle orifices 159. The center portion of each disk 158 is secured to the corresponding post 156 by an integral rivet 162, and the peripheral portion of each disk 158 is captured within an annular groove formed within a tubular portion 164 of an axially adjustable control plate 165. The spray pattern from each nozzle disk 158 may be varied between a wide spray pattern and a narrow spray pattern by flexing each disk 158 between a flat position and a concave position in response to axial movement of a plate 165 when the control ring 140 is rotated.

From the drawings and the above description, it is apparent that a shower head constructed in accordance with the present invention, provides desirable features and advantages. As one feature, the tubular or annular control member or sleeve 70 with its internal cartridge 75, provides for conveniently selecting various spray functions and eliminates any problem caused by water pressure on internal parts. The replaceable cartridge 75 also permits convenient use of different cartridges with a different set of internal channels or passages 81 and 82 to provide for different combinations of spray functions. The motor 35 also provides a simplified drive for slowly rotating the rotary valve member 55 to produce a cycling flow rate, and the axial movement of the control plate 135 or 165 provides a simplified means for infinitely adjusting the spray pattern between a wide spray pattern and a narrow spray pattern. In addition, the annular control valve member or sleeve 70 may also be positioned so that the cycling flow rate of water produced by the rotating valve member 55 flows alternately between the set of outer cavities 98 and the set of inner cavities 103 in order to produce automatic cycling of the flow rate in combination with automatic cycling between slow and fast pulsation to provide a different spray sensation.

While the forms of shower head herein described constitute preferred embodiments of the invention, it is to be understood that the invention is not limited to these precise forms of shower heads, and that changes may be made therein without departing from the scope and spirit of the invention as defined in the appended claims.

What is claimed is:

1. A shower head assembly comprising a housing, means for directing water into said housing, a water spray member connected to said housing and having a plurality of orifices for directing water from said housing in water streams forming a spray, a rotary cycling valve member within said housing, a water activated motor for continuously rotating said valve member, a rotatable tubular control valve member surrounding said housing, and said tubular control member including a removable internal cartridge having an inner surface with a series of circumferentially spaced passages for selectively directing water to said spray member or from said cycling valve member to said spray member in response to rotation of said control valve member to provide the option of a cycling flow rate of water to said orifices.

2. A shower head assembly as defined in claim 1 and including a water actuated rotary turbine wheel cooperating with said orifices for pulsating the water streams, radially spaced sets of inner and outer drive ports for directing water streams towards said turbine wheel at radially spaced locations, and a set of passages for directing water from said passages within said control valve member to said sets of inner and outer drive ports for varying the speed of said turbine wheel and the corresponding pulsation frequency of the water streams.

3. A shower head assembly as defined in claim 1 wherein said spray member comprises a plurality of projecting bosses each having peripherally spaced said orifices, a collar surrounding each boss, and a spray control member for simultaneously moving said collars axially on the corresponding said bosses to vary the spray pattern of water streams between narrow and wide patterns.

4. A shower head assembly as defined in claim 1 wherein said spray member comprises a plurality of spaced flexible disks each having a plurality of said orifices, and a control member connected to said disks for simultaneously flexing said disks to vary the spray pattern of the water streams between narrow and wide patterns.

5. A shower head assembly as defined in claim 1 wherein said water activated motor comprises a housing supporting a shaft having an eccentric portion within a rotor chamber, and a gear-like rotor within said rotor chamber and supported for orbital movement by said eccentric shaft portion in response to pressurized water.

6. A shower head assembly as defined in claim 1 wherein said tubular control valve member has an outwardly projecting base flange forming a control ring for manually rotating said control valve member.

7. A shower head assembly as defined in claim 1 wherein said housing has a cylindrical wall with at least one radial port upstream of said cycling valve member, and at least one of said passages within said control valve member may be positioned to connect said port to said orifices for producing a non-cycling spray.

8. A shower head assembly comprising a housing, means for directing water into said housing, a water spray member connected to said housing and having a plurality of orifices for directing water from said housing in water streams forming a spray, a rotary cycling valve member within said housing, a water activated motor for continuously rotating said valve member, a water actuated rotary turbine wheel within said housing and cooperating with said orifices for pulsating the water streams, radially spaced inner and outer drive ports for directing water streams towards said turbine wheel at radially spaced locations for continuously rotating said turbine wheel selectively at different speeds, and a set of passages for directing water from said valve member alternately to said inner and outer drive ports for automatically and alternately selecting the different speeds of said turbine wheel and for automatically producing corresponding different pulsation frequencies of the water streams.

9. A shower head assembly as defined in claim 8 wherein said water activated motor comprises a housing supporting a shaft having an eccentric portion within a rotor chamber, and a gear-like rotor within said rotor chamber and supported for orbital movement by said eccentric shaft portion in response to pressurized water.

10. A shower head assembly as defined in claim 8 wherein said spray member comprises a plurality of projecting bosses each having peripherally spaced said orifices, a collar surrounding each boss, and a spray control member for simultaneously moving said collars axially on the corresponding said bosses to vary the spray pattern of water streams between narrow and wide patterns.

11. A shower head assembly as defined in claim 8 wherein said spray member comprises a plurality of spaced flexible disks each having a plurality of said orifices, and a control member connected to said disks for simultaneously flexing said disks to vary the spray pattern of the water streams between narrow and wide patterns.

12. A shower head assembly as defined in claim 8 wherein said housing defines at least one radial port upstream of said cycling valve member, and a passage connecting said port to said orifices for producing continuous spray.

13. A shower head assembly comprising a housing, means for directing water into said housing, a water spray member connected to said housing and having a plurality of orifices for directing water from said housing in water streams forming a spray, a rotary cycling valve member within said housing, a water activated motor having an output shaft connected to rotate said valve member, said output shaft including an eccentric shaft portion within a rotor chamber, a rotor within said rotor chamber and supported for orbital movement by said eccentric shaft portion in response to pressurized water within said chamber, and a control valve for selectively directing water to said spray member or from said cycling valve member to said spray member in response to movement of said control valve to provide the option of a cycling flow rate of water to said orifices.

* * * * *